US005483980A

United States Patent [19]

Lin

[11] Patent Number: 5,483,980

[45] Date of Patent: Jan. 16, 1996

[54] HAIR ROLLER

[76] Inventor: Te S. Lin, P.O. Box 82-144, Taipei, Taiwan

[21] Appl. No.: 177,941

[22] Filed: Jan. 6, 1994

[51] Int. Cl.[6] ..... A45D 2/12

[52] U.S. Cl. ..... 132/255; 132/259

[58] Field of Search ..... 132/259, 256, 132/255, 254, 253, 247, 246

[56] References Cited

U.S. PATENT DOCUMENTS

| | | | |
|---|---|---|---|
| 323,184 | 7/1885 | Matzinger | 132/246 |
| 1,592,688 | 7/1926 | Webster | 132/259 |
| 2,140,583 | 12/1938 | Jacobs | 132/246 |
| 2,162,286 | 12/1937 | Schmitt | 132/255 |
| 2,249,315 | 7/1941 | Laskaris | 132/259 |
| 2,530,197 | 11/1950 | Hall et al. | 132/247 |
| 3,500,837 | 3/1970 | Ferens | 132/253 |

*Primary Examiner*—John G. Weiss
*Attorney, Agent, or Firm*—Alfred Lei

[57] ABSTRACT

A hair roller including a rod made of liquid absorbing material, a cover pivotally connected with an end of the rod, made of liquid absorbing material and formed with a plurality of slots, and a flexible member partially inserted into the rod and capable of being bent on the cover, whereby the hair roller may facilitate curling hair.

1 Claim, 3 Drawing Sheets

PRIOT ART

PRIOT ART

HAIR ROLLER

BACKGROUND OF THE INVENTION

Since earliest time hair styles have been an important adjunct to costume fashion. Subject to fads as much as dress, they have reflected times of stress, both social and economic. Hair styles express individual taste within or outside the dictates of current fashion. They have also been used in different cultures to indicate position in the social order. However, the prior art hair roller has a lot of drawbacks and unsatisfactory in use.

As shown in FIGS. 1A and 1B, the prior art hair roller comprises a rod 10 formed with a plurality of slots 11 and a plurality of notches 12 and 13 at both ends. When in use, it is necessary to enclose the hair 14 with a piece of liquid absorbing paper 15, roll the liquid absorbing paper 15 together with the hair 14 on the rod 10, and then use a rubber ring 16 to fix the paper 15 and the hair 14 in place thereby causing much inconvenience in use. Furthermore, the paper 15 will be disposed of after use thus wasting source material and the rubber ring 16 will form a concave line in the hair hence impairing the beauty of the hair.

Therefore, it is an object of the present invention to provide an improved hair roller which may obviate and mitigate the above-mentioned drawbacks.

SUMMARY OF THE INVENTION

This invention relates to an improved hair roller.

It is the primary object of the present invention to provide a hair roller which is easy to use.

It is another object of the present invention to provide a hair roller which can facilitate curling hair.

It is still another object of the present invention to provide a hair roller which is simple in construction.

It is still another object of the present invention to provide a hair roller which is low in cost.

It is a further object of the present invention to provide a hair roller which is facile to manufacture.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1B:
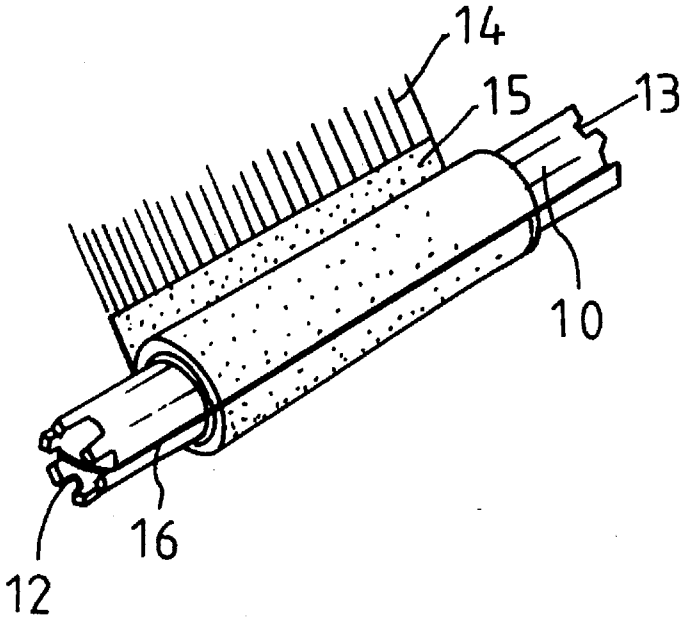
FIG. 1B is a perspective view of the prior art hair roller in closed position.
Figure 1A:
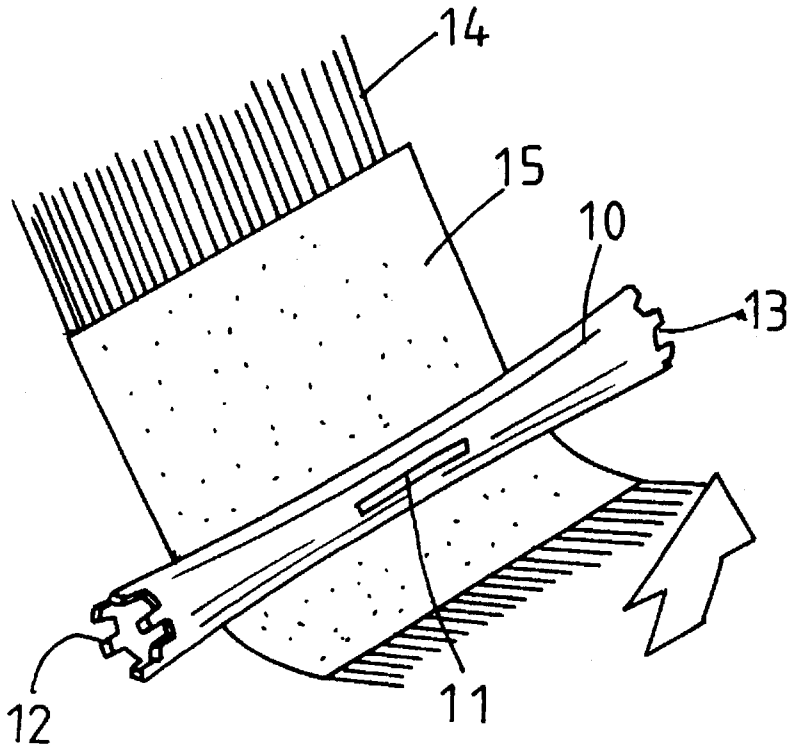
FIG. 1A is a perspective view of a prior art hair roller in open position.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
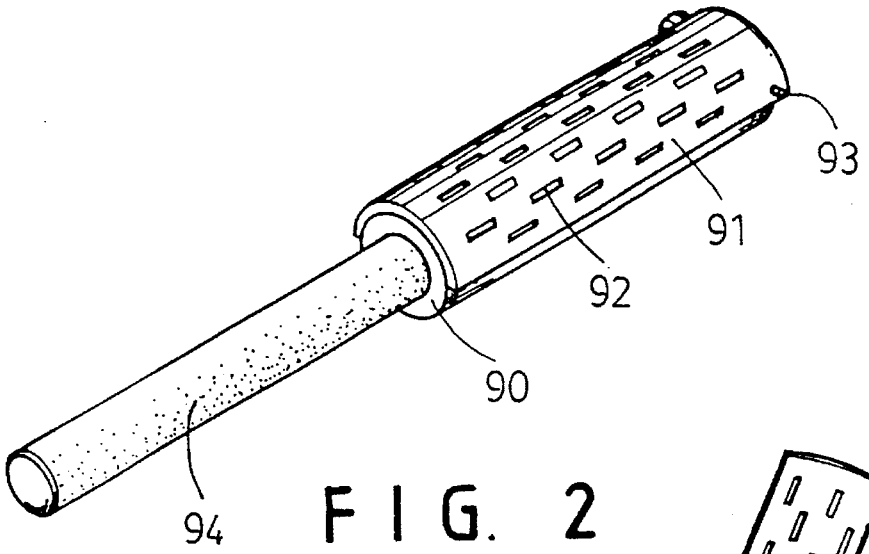
FIG. 2 is a perspective view of a hair roller according to the present invention.
Figure 3:
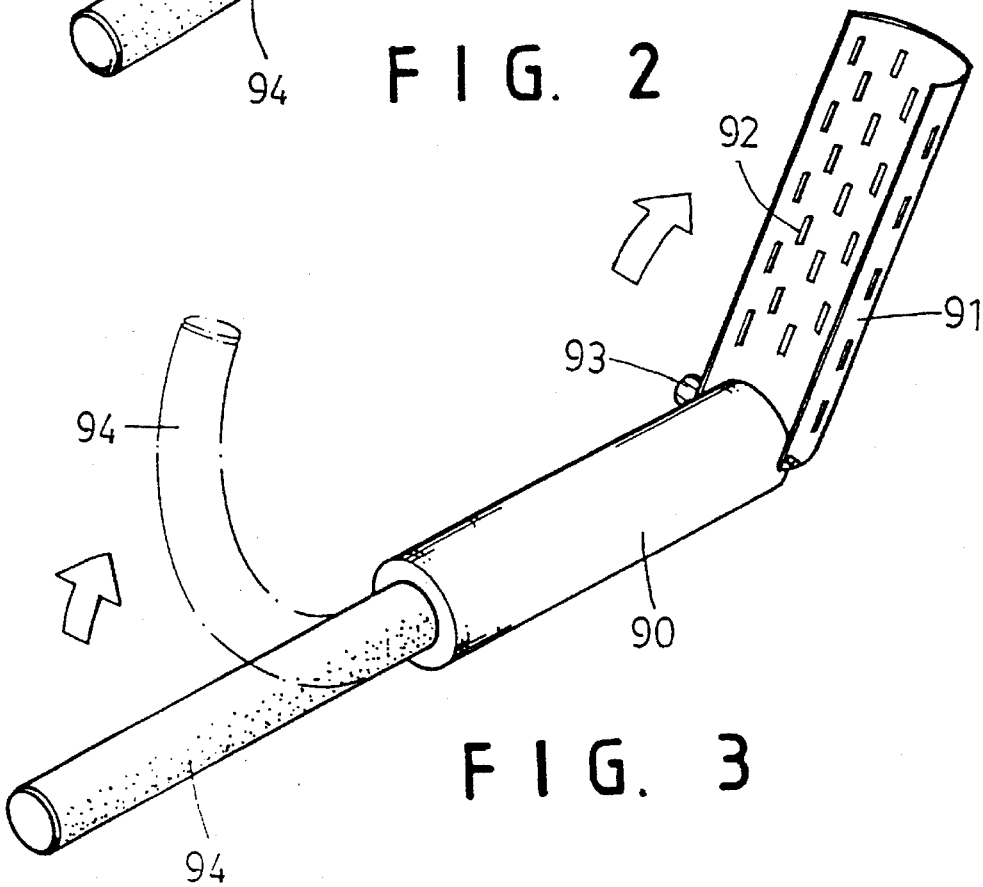
FIG. 3 shows the hair roller according to the present invention in open position.
Figure 4:
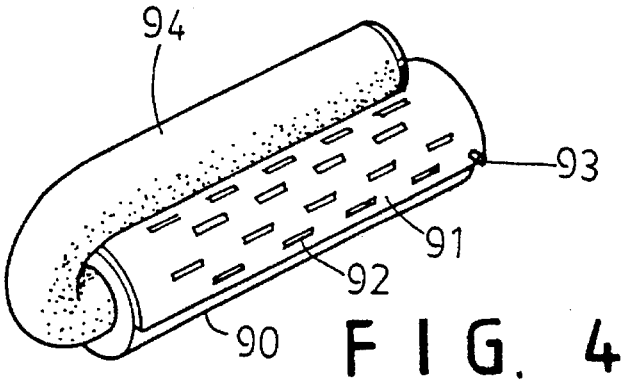
FIG. 4 shows the hair roller according to the present invention in closed position.

With reference to the drawings and in particular to FIGS. 2, 3 and 4 thereof, the hair roller according to the present invention mainly comprises a rod 90, a cover 91, and a flexible member 94. Preferably, the rod 90 is cylindrical in shape.

The cover 91 is semi-cylindrical in shape and pivotally mounted at one end of the rod 90 by a pin 93. Further, the cover 91 is formed with a plurality of slots 92. The rod 90 and the cover 91 are both made of liquid absorbing material. The flexible member 94 is partially inserted into the rod 90 and can be bent on the cover 91.

Figure 5:
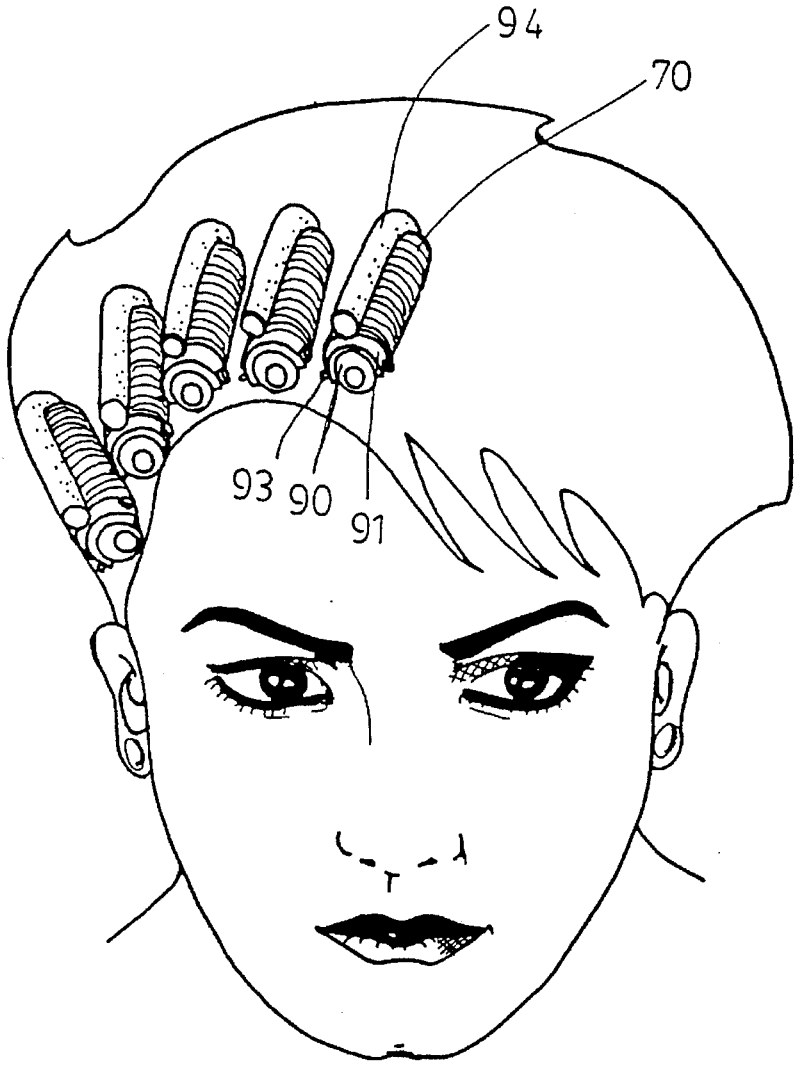
FIG. 5 is a working view of hair roller according to the present invention.
Figures 6A, 6B, 6C:
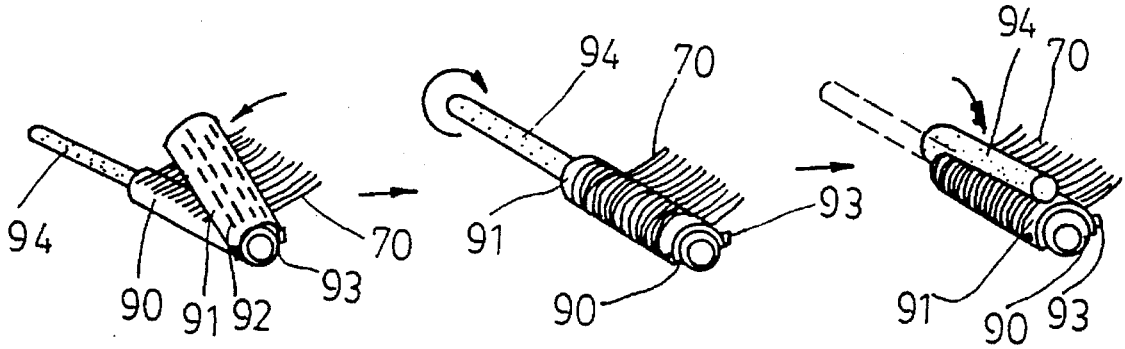
FIGS. 6A, 6B and 6C illustrate the way to use the hair roller according to the present invention.

When in use, first open the cover 91 and place the hair 70 on the rod 90 as shown in FIG. 6A. Then, close the cover 91 on the rod 90 thereby placing the hair between the rod 90 and the cover 91 as shown in FIG. 6B. Thereafter, bend the flexible member 94 on the cover 91 to keep the hair in position as shown in FIG. 6C. FIG. 5 shows a working view of the present invention.

Hence, it is no longer necessary to use liquid permissible paper, resilient rings, and pins when using the hair roller according to the present invention for hair curling.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A hair roller comprising:

a cylindrical rod made of a liquid absorbing material;

a semi-cylindrical cover pivotally connected to an end of said cylindrical rod and formed with a plurality of slots, said cover made of a liquid-absorbing material adapted to clamp hair against said cylindrical rod; and a flexible member partially inserted into said rod and capable of being bent on said cover to keep hair in position.

* * * * *